US008940250B2

(12) United States Patent
Pfeffinger et al.

(10) Patent No.: US 8,940,250 B2
(45) Date of Patent: Jan. 27, 2015

(54) METHOD OF CONVEYING LIQUIDS

(75) Inventors: Joachim Pfeffinger, Ludwigshafen (DE); Willi Gilcher, Ehweiler (DE); Juergen Morell, Speyer (DE)

(73) Assignee: BASF SE, Ludwigshafen (DE)

( * ) Notice: Subject to any disclaimer, the term of this patent is extended or adjusted under 35 U.S.C. 154(b) by 392 days.

(21) Appl. No.: 13/382,740

(22) PCT Filed: Jul. 6, 2010

(86) PCT No.: PCT/EP2010/059627

§ 371 (c)(1), (2), (4) Date: Jan. 6, 2012

(87) PCT Pub. No.: WO2011/003899

PCT Pub. Date: Jan. 13, 2011

(65) Prior Publication Data

US 2012/0116099 A1 May 10, 2012

(30) Foreign Application Priority Data

Jul. 9, 2009 (EP) ..... 09165074

(51) Int. Cl.
*B01L 3/00* (2006.01)
*F04B 53/14* (2006.01)
(Continued)

(52) U.S. Cl.
CPC ..... *F04B 53/141* (2013.01); *F04B 15/04* (2013.01); *F04B 39/0011* (2013.01); *F04B 43/02* (2013.01); *F04F 1/02* (2013.01); *F04F 1/14* (2013.01); *F04F 1/18* (2013.01)
USPC ..... 422/505; 422/500; 422/501; 422/502; 422/503; 436/180

(58) Field of Classification Search
CPC ..... B01J 2/00; C07C 20/00; C07C 209/72
USPC ..... 422/500–503, 505; 436/180
See application file for complete search history.

(56) References Cited

U.S. PATENT DOCUMENTS 4,527,957 A 7/1985 Dettinger et al.
4,961,688 A * 10/1990 Brun ..... 417/92
(Continued)

FOREIGN PATENT DOCUMENTS

CA 1162104 A1 2/1984
CA 2047055 A1 1/1992
(Continued)

OTHER PUBLICATIONS

English Translation of International Preliminary Report on Patentability from corresponding International Application No. PCT/EP2010/059627 dated Jan. 30, 2012.

*Primary Examiner* — Jyoti Nagpaul
(74) *Attorney, Agent, or Firm* — Drinker Biddle & Reath LLP

(57) ABSTRACT

The present invention relates to a method of continuously conveying a liquid which is used as starting material in a chemical reaction by means of a displacement pump having physically separate forward-transport valves and a liquid-filled bidirectional flow line between displacement pump and forward-transport valves, wherein an auxiliary liquid which is a product or a starting material of the chemical reaction and has a melting point which is below the melting point or below the saturation temperature of the liquid to be conveyed is present in the bidirectional flow line.

The present invention additionally provides for the use of a product formed by hydrogenation of an aromatic compound as auxiliary liquid for conveying an aromatic compound and also the use of an alcohol or an ester derived from alcohol and carboxylic acid as auxiliary liquid for conveying carboxylic acids or carboxylic acid derivatives.

16 Claims, 1 Drawing Sheet

(51) Int. Cl.

| | |
|---|---|
| ***F04B 15/04*** | (2006.01) |
| ***F04B 39/00*** | (2006.01) |
| ***F04B 43/02*** | (2006.01) |
| ***F04F 1/02*** | (2006.01) |
| ***F04F 1/14*** | (2006.01) |
| ***F04F 1/18*** | (2006.01) |

(56) References Cited

U.S. PATENT DOCUMENTS

| | | | | |
|---|---|---|---|---|
| 5,046,925 | A | 9/1991 | Fletcher | |
| 6,234,766 | B1 * | 5/2001 | De Koning | 417/321 |
| 2010/0292510 | A1 | 11/2010 | Pfeffinger et al. | |
| 2011/0137083 | A1 * | 6/2011 | Pfeffinger | 564/450 |

FOREIGN PATENT DOCUMENTS

| | | | |
|---|---|---|---|
| DE | 1453576 | A1 | 2/1969 |
| DE | 1528547 | A1 | 11/1969 |
| DE | 2132547 | A1 | 1/1973 |
| DE | 2553794 | A1 | 6/1977 |
| DE | 3021851 | A1 | 12/1981 |
| DE | 4124 290 | A1 | 1/1992 |
| DE | 19782185 | T1 | 11/1999 |
| EP | 36945 | A2 | 10/1981 |
| EP | 048535 | A1 | 3/1982 |
| FR | 608718 | A | 8/1926 |
| FR | 877570 | A | 12/1942 |
| GB | 1235489 | A | 6/1971 |
| WO | WO-80/01706 | A1 | 8/1980 |
| WO | WO-2009-090179 | | 7/2009 |
| WO | WO-2009153123 | | 12/2009 |
| WO | WO-2011003899 | | 1/2011 |

* cited by examiner

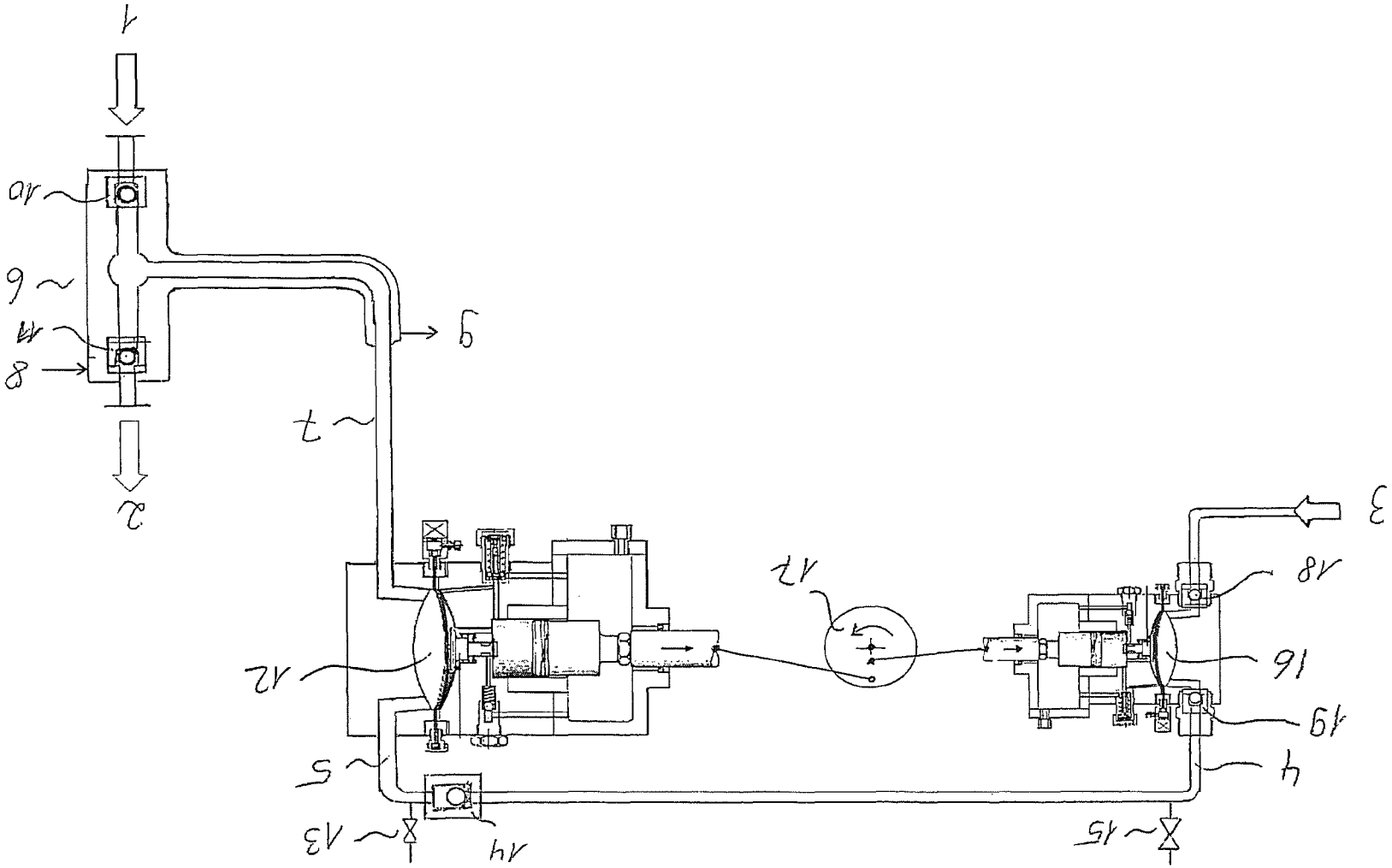
1
2
3
4
5
6
7
8
9
10
11
12
13
14
15
16
17
18
19

METHOD OF CONVEYING LIQUIDS

PRIORTY

Priority is claimed as a national stage application, under 35 U.S.C. §371, to PCT/EP2010/059627, filed Jul. 6, 2010, which claims priority to European Application No. 09165074.7, filed Jul. 9, 2009. The disclosures of the aforementioned priority applications are incorporated herein by reference in their entirety.

DESCRIPTION

The invention relates to a method of continuously conveying a liquid which is used as starting material in a chemical process. The invention further relates to a process for hydrogenating aromatic compounds, in particular aromatic amines, and a process for preparing esters, in which the starting materials are fed to the reactor by means of the inventive method of continuously conveying liquids. The present invention additionally provides for the use of a product formed by hydrogenation of an aromatic compound as auxiliary liquid for conveying an aromatic compound and also the use of an alcohol or an ester derived from alcohol and carboxylic acid as auxiliary liquid for conveying carboxylic acids or carboxylic acid derivatives.

Various possible ways of continuously conveying hot and in particular molten materials in a pressure system are described in the technical literature, for example in Ullmann's Encyclopedia of Industrial Chemistry, High-Pressure Technology (Electronic Release DOI: 10.1002/14356007.b04_587).

When centrifugal pumps and rotary pumps are used, it is necessary either to connect numerous pump stages in series or to use a very high speed of rotation in order to achieve the required high differential pressure. To prevent solidification of the product in the pump, very complicated and thus costly constructions have to be used for fully heating all components in contact with the product. For this reason, these types of pumps are generally used only for applications in which, in particular, large volume streams are to be conveyed.

To convey smaller volume streams, it is possible to use for example heatable gear pumps. However, a disadvantage of this type of pump is that a sealed drive shaft going through to the outside has to be used for driving the gears and contamination of the medium being conveyed with sealants and lubricants or escape of the medium to be conveyed to the outside can occur.

This disadvantage is overcome by a high-pressure diaphragm pump since the drive is effected by means of a hermetically sealed diaphragm and neither contamination with sealants and lubricants nor escape of the medium being conveyed to the outside can therefore occur. However, diaphragm pumps cannot be used for conveying hot liquids or melts because of the low thermal stability of the diaphragm materials (e.g. polyethylene (PE) or polytetrafluoroethylene (PTFE)) and the inability to effect total heating. It is therefore necessary to use either metallic diaphragms with fully heatable pump heads or "bidirectional pump systems".

Bidirectional pump systems are described, for example in DE-A-1453576, DE-A-1528547, EP-A1-048535, DE-A1-3021851, DE-T5-19782185, DE-A-2553794, WO-A-80/01706, DE-A-4124 290 or EP-B1-36945.

DE-A-1453576 describes an apparatus for pumping a corrosive liquid, for example ammonium carbamate solution, by means of a bidirectional pump apparatus which is divided into two elements. The first element ("main pump") sets a noncorrosive auxiliary liquid, for example water, into oscillating motion and thus drives, via a connecting line ("bidirectional flow line"), the second pump element having two nonreturn valves for conveying the corrosive liquid. The auxiliary liquid is continually fed into the connecting line by means of a small auxiliary pump.

DE-A-1528547 describes a virtually identical pump concept with continual introduction of a neutral auxiliary liquid into the bidirectional flow line.

EP-A1-048535 describes a bidirectional pump system for conveying a hot coal suspension, in which an oil which is miscible with the coal suspension is used as auxiliary liquid.

DE-A1-3021851 describes a bidirectional pump system in which the auxiliary liquid is preferably immiscible with the liquid to be conveyed and the bidirectional flow line has a very compact spatial arrangement.

DE-T5-19782185 describes a bidirectional pump system for pumping hot media and solid/liquid mixtures ("slurries") using a pump similar to that described in DE-A-1453576, where the bidirectional flow line is cooled in the horizontal part in order to prevent overheating of the main pump. No auxiliary liquid is added here.

WO-A-80/01706 likewise describes a bidirectional pump system for pumping hot liquids, in which the connecting line comprises a horizontal part and a vertical part and is likewise cooled.

A similar system is described in DE-A-4124 290.

DE-A-2553794 discloses a bidirectional pump system having a vertical bidirectional flow line, in which a temperature gradient between hot liquid and main pump is maintained by cooling.

EP-B1-36945 describes a similar pump apparatus in which a movable piston is said to prevent mixing of liquid being conveyed and auxiliary liquid.

The pump systems described in the prior art have disadvantages in the conveying of hot liquids.

In the case of high-pressure diaphragm pumps, the maximum permissible temperature of the medium being conveyed is generally set by the stability of the diaphragm material, for example, when polymer diaphragms such as PE or PTFE diaphragms are used.

The use of metal diaphragms would, owing to their very low flexibility, lead to very large and thus expensive pump heads.

Furthermore, the pump heads of diaphragm pumps are not fully heatable, especially at the diaphragm drive and at the diaphragm itself, so that solids formation (crystallization) and thus mechanical destruction of the membrane can occur when pumping melts.

When high-pressure piston pumps are used, a lubricating oil or similar liquid is generally required for lubricating the piston. This can mix with the liquid to be conveyed and thus contaminate the latter. Full heating of piston pumps is generally likewise not possible, so that deposits can likewise form at unheated places in the pump.

High-pressure diaphragm pumps having a bidirectional flow line to a physically separate pump body with suction and forward-transport valves are in principle suitable for conveyance of hot melts. However, such a pump arrangement requires the use of an auxiliary liquid for transmitting the pump motion from the diaphragm pump to the melt to be conveyed. Part of the auxiliary liquid can mix with the melt to be conveyed. This leads to contamination of the liquid to be conveyed with the auxiliary liquid.

Cooling of the bidirectional flow line generally leads after a short time to parts of the melt diffusing through the bidirectional flow line in the direction of the main pump, solidifying there and leading to blockage of the pump. The use of auxiliary pistons in the bidirectional flow line would likewise lead to rapid blockage of the piston by solidifying melt.

It was therefore an object of the invention to convey a liquid at high temperature without contamination by, for example, solvents or sealants into a chemical high-pressure reactor. A particular object was to reduce the formation of deposits and residues in the pump system in the conveying of liquids which tend to form deposits. Liquids which can form deposits and residues are, for example, liquids which themselves or constituents thereof can solidify, crystallize or precipitate when the temperature goes below a minimum value. In particular, it was an object of the present invention to develop a method of conveying organic melts and concentrated solutions of organic compounds, especially organic melts, in which costly constructions for full heating of all components in contact with the product, in particular the diaphragm of a diaphragm pump, should be dispensed with in order to keep capital and operating costs as low as possible.

The object of the invention has been achieved by a method of continuously conveying a liquid which is used as starting material in a chemical reaction by means of a displacement pump having physically separate forward-transport valves and a liquid-filled bidirectional flow line between displacement pump and forward-transport valves, wherein an auxiliary liquid which is a product or a starting material of the chemical reaction and has a melting point which is below the melting point or below the saturation temperature of the liquid to be conveyed is present in the bidirectional flow line.

To carry out the method of the invention, use is made of a pump system which comprises a displacement pump ("main pump") having physically separate forward-transport valves and a bidirectional flow line between displacement pump and forward-transport valves.

The forward-transport valves are generally accommodated in a housing. The housing together with the forward-transport valves located therein will hereinafter be referred to as "valve body".

The valve body generally has an inlet on the suction side and an outlet on the pressure side. The inlet and the outlet are usually connected to a feed line on the suction side and a discharge line on the pressure side through which the liquid to be conveyed is conveyed.

The forward-transport valves are usually arranged at the inlet and at the outlet in the valve body, so that the liquid to be conveyed is passed through the valves.

The valves are generally constructed so that the liquid to be conveyed can pass through the valves only from the suction side in the direction of the pressure side. The flow in the opposite direction (from the pressure side to the suction side) is generally blocked.

For example, the valves can be configured as nonreturn valves, preferably ball nonreturn valves.

Between the valves there is usually a hollow space in the valve body through which the liquid to be conveyed flows. This space is usually configured as a tube having a preferably cylindrical geometry, although the geometry can also deviate from the cylindrical geometry and can, for example, also be spherical.

In a preferred embodiment, the valve body is arranged vertically or upright, i.e. the axis which can be drawn through the forward-transport valves and the space between the forward-transport valves runs vertically.

The forward-transport valves are separated physically from the displacement pump by means of a bidirectional flow line.

The bidirectional flow line preferably has an "L"-shaped geometry, i.e. the bidirectional flow line has, in this geometry, a region which runs horizontally and a part which runs vertically. Deviations from this geometry are possible, for example, to make possible a connection between displacement pump and valve body when the arrangement of displacement pump and valve body does not permit a strictly "L"-shaped geometry because of the nature of the construction.

If the valve body is arranged vertically, the horizontal part of the bidirectional flow line usually opens into the valve housing in the hollow space between the two forward-transport valves. The vertical region of the bidirectional flow line adjoining the horizontal part of the bidirectional flow line is generally connected directly or via a further region of the bidirectional flow line which does not necessarily have to be vertical, to the pump space of the displacement pump.

If the valve body is arranged horizontally, the vertical part of the bidirectional flow line usually opens into the hollow space of the valve body between the two forward-transport valves. The horizontal region of the bidirectional flow line adjoining the vertical part of the bidirectional flow line is generally connected directly or via a further region of the bidirectional flow line, which does not necessarily have to be horizontal, to the pump space of the displacement pump.

In a preferred embodiment, the part of the bidirectional flow line which is connected to the valve body and the valve body itself are heated to a temperature above the melting point or above the saturation temperature of the liquid to be conveyed.

Heating of the heated part of the bidirectional flow line and the valve housing can usually be carried out by means of steam or heat-transfer oil.

The heated part of the bidirectional flow line is preferably so large that together with the hollow space in the valve body between the two forward-transport valves it comprises at least one volume which corresponds approximately to from 3 to 20 times, preferably from 5 to 15 times and particularly preferably from 7 to 12 times, the displacement volume of the displacement pump. It is thus generally ensured that the liquid to be conveyed comes into contact only with the heated part of the bidirectional flow line. The bidirectional flow line is connected to the pressure side of a displacement pump ("main pump").

The displacement pump ("main pump") is preferably a piston pump or a diaphragm pump, with particular preference being given to a diaphragm pump because it does not require any sealants and lubricants which could contaminate the liquid to be conveyed. Suitable diaphragm materials are elastomer materials such as ethylene-propylenediene rubber (EPDM), silicone rubber (MVO, VMO), fluorosilicone rubber (MFO, FVMO), fluoro rubber (FPM, FKM), perfluoro rubber (FFKM, FFPM), polychloroprene rubber (CR), nitrile-butadiene rubber (NBR), polyester-urethane rubber (AU, EU), butyl rubber (IIR) and natural rubber (NR). It is also possible to use polymer diaphragms composed of polytetrafluoroethylene (PTFE), polyethylene (PE) and polypropylene (PP) or other polymer diaphragms which are chemically resistant to the auxiliary liquid used. It is also possible to use coated diaphragms such as PTFE-coated elastomer diaphragms or multilayer diaphragms composed of various materials.

Preferred diaphragm materials are polytetrafluoroethylene (PTFE) and polyethylene (PE), with particular preference being given to using PTFE and PTFE-coated elastomer diaphragms as diaphragm material for conveying aromatic compounds and carboxylic acids or carboxylic acid derivatives.

The main pump is connected on the suction side to a pipe ("connecting line") through which auxiliary liquid can be fed in.

The auxiliary liquid is preferably fed in through the connecting line by means of a further displacement pump ("auxiliary pump").

The auxiliary pump is a displacement pump which is preferably configured as a piston or diaphragm pump, particularly preferably as a diaphragm pump. Suitable diaphragm materials are the materials mentioned above, for example PTFE and PTFE-coated diaphragms which are resistant to the respective auxiliary liquid.

A nonreturn valve is preferably installed in the connecting line to prevent liquid from flowing from the main pump in the direction of the auxiliary pump.

Between nonreturn valve and main pump, there is generally a valve for de-aerating the pump space of the main pump. This valve is generally installed at the highest point of the pump system in order to allow complete de-aeration.

In general, forward-transport valves are installed directly at the pump head of the auxiliary pump on the suction and pressure sides.

The forward-transport valves are generally constructed so that the liquid to be conveyed can pass through the valves only from the suction side in the direction of the pressure side. Flow in the opposite direction (from the pressure side to the suction side) is generally blocked.

For example, the valves can be configured as nonreturn valves, preferably ball nonreturn valves.

A further valve is generally installed in the connecting line at the highest point between the forward-transport valve on the pressure side and the nonreturn valve to de-aerate this part of the pipe.

The suction side of the auxiliary pump is connected to a reservoir, for example a container or a tank, in which the auxiliary liquid is present.

The auxiliary liquid can be heated, for example, by means of a heat exchanger or by heating the reservoir, before being introduced into the pump space of the auxiliary pump. The temperature here should not be so high that either the main pump or the auxiliary pump, in particular the diaphragm material of a diaphragm pump, is damaged.

The bidirectional flow line is generally filled with liquid.

The bidirectional flow line and the space within the valve body between the forward-transport valves are preferably filled completely or virtually completely with auxiliary liquid before commencement of the inventive method of conveying liquids, i.e. before commencement of the pumping operation. It is advantageous for at least the unheated part of the bidirectional flow line to be filled with auxiliary liquid, since the auxiliary liquid has a lower melting point than the liquid to be conveyed and does not have to be heated, or does not have to be heated as much, in order to remain liquid. The formation of deposits of solids in the pump system can thus be reduced further.

To start the conveying operation, the auxiliary liquid in the main pump and the valve body is generally initially pumped out of the pump system by a stroke of the main pump (forward stroke). The forward-transport valve in the valve body on the suction side prevents backflow in the direction of the reservoir for the liquid to be conveyed and the nonreturn valve in the connecting line prevents auxiliary liquid pumped out of the main pump from being able to flow back to the auxiliary pump.

The liquid to be conveyed is conveyed by means of a suction stroke of the main pump through the feed line on the suction side into the valve body and partly into the bidirectional flow line.

Here, the liquid to be conveyed generally does not go into the entire bidirectional flow line since the auxiliary liquid generally forms a type of liquid barrier which prevents spreading of the liquid to be conveyed into the bidirectional flow line. In this way, it is generally ensured that the displacement pump, in particular also the diaphragm of a diaphragm pump, does not come into contact with the liquid to be conveyed but is instead generally surrounded by the auxiliary liquid.

However, the auxiliary liquid generally does not form an ideal liquid barrier, so that part of the liquid to be conveyed mixes with the auxiliary liquid and diffuses in the direction of the main pump, for example when there is a high temperature gradient between the heated valve body and the pump head of the main pump. The diffusion of the liquid to be conveyed can lead to deposits in the region of the main pump and the unheated part of the part of the bidirectional flow line.

To reduce the formation of these deposits in the region of the unheated parts of the pump system, the auxiliary liquid is, according to the invention, introduced into the bidirectional flow line. The introduction of the auxiliary liquid brings about flow in the direction of the valve body of the main pump, which generally counters the spread by convection or diffusion of the liquid to be conveyed.

The introduction is preferably carried out continuously.

In a preferred embodiment, the auxiliary liquid is introduced by means of a displacement pump ("auxiliary pump") through the connecting line into the pump space of the main pump. A nonreturn valve in the connecting line generally allows the liquid to flow only in the direction of the main pump.

The ratio of the volume flow of the auxiliary liquid to the volume flow of the liquid to be conveyed is preferably in the range from 1:100 to 1:10, particularly preferably in the range from 1:80 to 2:10, in particular from 1:50 to 5:10.

The forward and suction strokes are repeated by oscillatory motions of the main pump, with the pumping motion being transmitted by the auxiliary liquid to the liquid to be conveyed so that the liquid to be conveyed can be conveyed continuously through the inlet of the valve body in the direction of the outlet.

In a preferred embodiment, the connecting rods of the main pump and of the auxiliary pump are mechanically coupled to one another. The mechanical coupling is configured in such a way that the auxiliary pump is making a forward stroke precisely when the main pump is making a suction stroke and vice versa. However, it is also possible to drive the two pumps by means of separate drives and synchronize the strokes electronically, for example, by means of variable frequency converters.

Since the pump head of the main pump, in particular the diaphragm of a diaphragm pump, and the major part of the bidirectional flow line usually comes into contact only with the auxiliary liquid, the temperature in this region can be set to a lower value since it is necessary only for the temperature in the region of the pump head and in the unheated part of the bidirectional flow line to be sufficiently high for the auxiliary liquid to remain in the liquid state and the formation of deposits to be very largely avoided. In a preferred embodiment, the pump head of the main pump and the unheated part of the bidirectional flow line are not additionally heated and an auxiliary liquid which has a melting point below ambient temperature is used. This embodiment allows a particularly economical configuration of the pump system. To reduce the temperature difference between auxiliary liquid and the liquid to be conveyed, for example in order to reduce diffusion of the liquid to be conveyed into the auxiliary liquid, the auxiliary liquid can be heated before introduction into the pump space of the auxiliary pump, as described above.

The geometric configuration of the pump system is generally selected as a function of the materials to be conveyed. If the density of the liquid to be conveyed is higher than the density of the auxiliary liquid, in each case at the operating temperatures, the valve body is usually arranged at a lower level than the main pump. Correspondingly, the valve body is generally arranged above the main pump if the liquid to be conveyed has a density lower than that of the auxiliary liquid.

A preferred embodiment of the inventive method of conveying liquids is described below with reference to the accompanying schematic drawing (FIG. 1), but without implying a restriction thereto:

FIG. 1 shows schematically the bidirectional flow pump system of the invention for melts.

Here, (1) denotes the inflow of the melt (suction side) and (2) denotes the outflow of the melt (pressure side) to the chemical process. The valve body (6) has valves on the suction side (10) and on the pressure side (11) of the melt, which allow liquid to pass only in the flow direction (1) to (2) but block flow in the opposite direction. Between the valves (10) and (11) there is a pipe, the bidirectional flow line (7), which is filled completely with liquid. The valve body (6) and the lower part of the bidirectional flow line (7) are heated by means of a heating medium, for example, steam or heat-transfer oil, in order to prevent solidification of the melt in the valve body or in the bidirectional flow line. The positions (8) and (9) show inflow and outflow of the heating medium.

The bidirectional flow line (7) is connected to the main diaphragm pump (12). The diaphragm is driven via a connecting rod by a motor with gearbox (17). The diaphragm pump (12) is connected via a second pipe (connecting line) (5) to the metering of auxiliary liquid. In this feed line for the auxiliary liquid there is a nonreturn valve (14) which prevents liquid being able to flow from the main pump (12) in the direction of the auxiliary pump (16). Between nonreturn valve (14) and diaphragm pump (12) there is, at the highest point, a valve (13) for complete de-aeration of the pump space (5), (12), (7).

The auxiliary liquid is fed by means of a small diaphragm metering pump, the auxiliary pump (16), to the main pump (12). Here, (3) denotes the feed line for the auxiliary liquid (suction side) to the auxiliary pump (16) and the connection (4) denotes the pressure side of the auxiliary pump. In this auxiliary pump (16), the forward-transport valves (18) and (19) are installed directly at the diaphragm pump head on suction and pressure sides. At the highest point of the connecting line between pressure side of the auxiliary liquid and the nonreturn valve (14) there is a valve (15) for complete de-aeration of this pipe. The auxiliary pump (16) is driven mechanically by means of an electric motor and gearbox (17) via a connecting rod. In this preferred embodiment, the connecting rod of the main pump (12) and that of the auxiliary pump (16) are mechanically coupled with one another. The mechanical coupling is configured so that the auxiliary pump (16) is making a forward stroke precisely when the main pump (12) is making a suction stroke, and vice versa.

The method of the invention enables liquids which are used as starting materials in a chemical reaction to be conveyed.

The method of the invention enables, for example, starting materials for reactions such as hydrogenations, oxidations, esterifications and polymerizations to be conveyed into a chemical reactor.

The starting material can be used as a melt or as a concentrated solution of the starting material.

The liquid to be conveyed is particularly preferably used as a melt, particularly preferably as a melt of the commercially available pure material.

The use of a melt generally has the advantage that the compound to be conveyed does not have to be dissolved in a separate process step in order to obtain a conveyable liquid. In addition, the starting material is not diluted by a solvent so that the reactor can generally be supplied with a greater amount of starting material and complicated removal of the solvent after the reaction is complete is generally not necessary. However, the starting material can also be used as a solution of the starting material. As solvent for the starting material, use is generally made of the solvent which is preferably used in the corresponding process or in the respective reaction. This embodiment is advantageous when, for example, the starting materials tend to discolor or undergo secondary reactions on melting. The production of a concentrated solution of the starting material enables the temperature for conversion of the starting material into the liquid state to be reduced. In order to achieve a very high reactor loading, a solution which is as concentrated as possible is generally produced. The method of the invention makes it possible to convey concentrated solutions having a high saturation temperature, since continuous introduction of auxiliary liquid makes it possible to very largely prevent the concentrated solution from getting into the region of the pump head of the main pump.

For this reason it is also possible to use the starting material as a slurry in the auxiliary liquid. The method of the invention is thus also suitable for conveying infusible starting materials such as terephthalic acid, for example, for conveying a slurry of the starting material terephthalic acid in ethylene glycol.

The method of the invention particularly preferably makes it possible to convey melts which have a melting point of 20° C. or more, preferably 50° C. or more, particularly preferably 75° C. or more and very particularly preferably 100° C. or more. Furthermore, solutions of a starting material can preferably be conveyed, with the saturation temperature of the solution being a temperature of 20° C. or more, preferably 50° C. or more, particularly preferably 75° C. or more and very particularly preferably 100° C. or more.

For the purposes of the present invention, the saturation temperature is the temperature at which a solution of a starting material having a particular concentration reaches a state of saturation and the starting material begins to precipitate from the solution.

The temperature at which the liquid to be conveyed is conveyed is above the melting point thereof or above the saturation temperature thereof.

The temperature at which the liquid is conveyed is preferably from 1° C. to 100° C., above, preferably from 5° C. to 80° C. above and particularly preferably from 10° to 50° C. above, the melting point or the saturation temperature of the liquid to be conveyed.

In general, the temperature of the liquid to be conveyed should be not more than 300° C., preferably not more than 250° C. and particularly preferably not more than 200° C. Since the temperature of the auxiliary liquid in the region of the pump head is generally, as described below, limited by the heat resistance of the diaphragm, a high temperature gradient between valve body and pump space can lead to increased mixing between the liquid to be conveyed and the auxiliary liquid. In general, the ratio of the volume flow of the auxiliary liquid to the volume flow of the liquid to be conveyed should be higher, the higher the temperature gradient between valve body and pump space.

The auxiliary liquid is, according to the invention, a product of the chemical reaction or a starting material for the chemical reaction.

When a product of the chemical reaction is used as auxiliary liquid, preference is given to using the main product which is preferentially formed under the conditions of the respective chemical reaction as auxiliary liquid.

The use of either a starting material or a product of the chemical reaction as auxiliary liquid prevents the liquid to be conveyed from being contaminated by foreign substances.

The melting point of the auxiliary liquid is, according to the invention, below the melting point or below the saturation temperature of the liquid to be conveyed.

In a particular embodiment, the melting point of the auxiliary liquid is below the temperature at which the diaphragm of a diaphragm pump is stable, so that the diaphragm is not thermally damaged.

In a particularly preferred embodiment, the melting point of the auxiliary liquid is 150° C. or less, particularly preferably 100° C. or less, very particularly preferably 50° C. or less and in particular 25° C. or less. At these temperatures safe operation of diaphragm pumps is generally possible.

The temperature at which the auxiliary liquid is introduced into the connecting line is above its melting point.

The temperature at which the auxiliary liquid is introduced into the connecting line is preferably from 1° C. to 100° C. above, preferably from 5° C. to 80° C. above and particularly preferably from 10° to 50° C. above the melting point of the auxiliary liquid. The temperature at which the auxiliary liquid is introduced into the connecting line is very particularly preferably in the range from 0° C. to 150° C., preferably in the range from 10° C. to 100° C., particularly preferably in the range from 20° C. to 80° C. and in particular in the range from 20° C. to 50° C.

The boiling point of the auxiliary liquid should preferably be above the temperature at which the liquid to be conveyed is conveyed since otherwise undesirable gas formation can occur at the interface between auxiliary liquid and liquid to be conveyed in the region of the bidirectional flow line.

In a preferred embodiment, the auxiliary liquid is a product of the chemical reaction. This particularly preferred embodiment is preferably suitable for conveying an aromatic compound which is used as starting material for a hydrogenation.

Preferred starting materials are:

aromatic amines, such as aniline, benzidine, the isomeric toluidines, the isomeric xylidines, the isomeric xylylenediamines, 1- or 2-aminonaphthalene, TDA isomers (2,4-/2,6-/2,3-/3,4-toluenediamine) or MDA isomers (4,4'-methylenedianiline, 2,4'-methylenedianiline, 2,2'-methylenedianiline, polymeric MDA) and also mixtures thereof;

substituted MDA compounds, such as 3,3'-dimethyl-4,4'-diaminodiphenylmethane, 3,3',5,5'-tetramethyl-4,4'-diaminodiphenylmethane and 2,2',3,3'-tetramethyl-4,4'-diaminodiphenylmethane;

aromatic dinitriles, such as the isomeric phthalonitriles;

aromatic hydroxy compounds such as bisphenol A, bisphenol F or substituted bisphenols;

aromatic acid anhydrides, such as phthalic anhydride; or aromatic acids, such as benzoic acid.

Particular preference is given to conveying aromatic amines as starting materials into a hydrogenation.

To convey aromatic starting materials, the product of the hydrogenation of the aromatic starting material is used as auxiliary liquid according to the embodiment described here. If a plurality of hydrogenation products can be formed in the hydrogenation of the aromatic starting materials, preference is given to using the hydrogenation product which under the respective reaction conditions represents the main product. For example, 2,4-diamino-1-methylcyclohexane can be used as auxiliary liquid for conveying 2,4-toluenediamine.

The particularly preferred embodiment in which a product of the chemical reaction is used as auxiliary liquid is also suitable for conveying carboxylic acids or carboxylic acid derivatives in the preparation of esters or polyesters.

Preferred carboxylic acids are:

aromatic carboxylic acids, such as benzoic acid, in particular aromatic dicarboxylic acids, such as phthalic acid, isophthalic acid, terephthalic acid or the isomeric naphthalenedicarboxylic acids; or aliphatic carboxylic acids, in particular aliphatic dicarboxylic acids, such as adipic acid, succinic acid, glutaric acid, suberic acid, azelaic acid, sebacic acid, decanedicarboxylic acid, maleic acid or fumaric acid.

The carboxylic acids can be used either individually or in admixture with one another.

In this preferred embodiment, the corresponding carboxylic acid derivatives of carboxylic acids, for example the corresponding carboxylic anhydrides or esters thereof, for example the $C_1$-$C_4$ esters of the abovementioned carboxylic acids, can also be used as starting materials. Preference is given to using the corresponding carboxylic anhydrides of the abovementioned carboxylic acids, in particular phthalic anhydride, maleic anhydride or succinic anhydride.

In the esterification of carboxylic acids or carboxylic acid derivatives with alcohols, an ester of carboxylic acid and alcohol is, according to the embodiment described here, used as auxiliary liquid for conveying the carboxylic acid or the carboxylic acid derivative.

For example, methyl benzoate can be used as auxiliary liquid for conveying benzoic acid in the preparation of methyl benzoate from benzoic acid and methanol.

As a result of the use of the product obtained in the chemical reaction of the starting material as auxiliary liquid for conveying the starting material, there is no undesirable contamination of the liquid to be conveyed with foreign substances. Furthermore, no additional costs are incurred for freeing the final product of a solvent, for example.

In a further preferred embodiment, the auxiliary liquid in the inventive method of conveying a liquid is a starting material for the chemical reaction.

By means of this particularly preferred embodiment, preference is given to conveying carboxylic acids or carboxylic acid derivatives, which are used as starting materials for an esterification.

Preferred carboxylic acids are:

aromatic carboxylic acids, such as benzoic acid, in particular aromatic dicarboxylic acids, such as phthalic acid, isophthalic acid, terephthalic acid or the isomeric naphthalenedicarboxylic acids; or aliphatic carboxylic acids, in particular aliphatic dicarboxylic acids, such as adipic acid, succinic acid, glutaric acid, suberic acid, azelaic acid, sebacic acid, decanedicarboxylic acid, maleic acid or fumaric acid.

The carboxylic acids can be used either individually or in admixture with one another.

In this embodiment, the corresponding carboxylic acid derivatives of carboxylic acids, for example the corresponding carboxylic anhydrides or esters thereof, for example the $C_1$-$C_4$ esters of the abovementioned carboxylic acids, can also be used as starting materials. Preference is given to using the corresponding carboxylic anhydrides of the abovementioned carboxylic acids, in particular phthalic anhydride, maleic anhydride or succinic anhydride.

In this embodiment, a starting material for the chemical reaction is used as auxiliary liquid.

When conveying carboxylic acids or carboxylic acid derivatives, which are used as starting materials in an esterification, the auxiliary liquid is, according to the invention, an alcohol, with which the carboxylic acid or the carboxylic acid derivative is to be reacted.

As alcohol, it is possible to use, for example:

aliphatic alcohols, such as $C_1$-$C_{20}$ alcohols, preferably $C_1$-$C_4$ alcohols, such as methanol, ethanol, the isomeric propanols or the isomeric butanols; 2-ethylhexanol, aliphatic diols, such as $C_2$-$C_{20}$ diols, preferably 1,2-ethanediol, 1,3-propanediol, 1,2-propanediol, 1,4-butanediol, 1,5-pentanediol, 1,6-hexanediol, cyclohexanediol or neopentyl glycol;

aliphatic polyols, such as trimethylolpropane, trimethylolethane, pentaerythritol, glycerol and polytetrahydrofuran;

cycloaliphatic polyols such as monosaccharides, disaccharides and oligosaccharides and aqueous solutions thereof; or sugar alcohols, such as sorbitol, glucitol or hexanehexyl and aqueous solutions thereof.

The alcohols can be used either individually or in admixture with one another, depending on the ester or polyester to be prepared.

As indicated above, the method of the invention is preferably used for conveying aromatic compounds which are used in a hydrogenation.

The present invention accordingly provides a process for hydrogenating aromatic compounds, wherein an aromatic compound or a solution of an aromatic compound is fed to the reactor by means of a displacement pump having physically separate forward-transport valves and a liquid-filled bidirectional flow line between displacement pump and forward-transport valves, where an auxiliary liquid which is the product of the hydrogenation of the aromatic compound is present in the bidirectional flow line and the auxiliary liquid has a melting point which is below the melting point of the aromatic compound or below the saturation temperature of the solution of the aromatic compound.

The hydrogenation is usually carried out at suitable pressures and temperatures. The temperature is generally in the range from 50 to 300° C., with preference being given to the temperature range from 120 to 280° C., and the pressure is usually from 1 to 500 bar, preferably from 50 to 325 bar, particularly preferably from 150 to 250 bar. The hydrogenation process can be carried out continuously or in the manner of a batch process.

In the case of a continuous process, the amount of the compound or compounds provided for the hydrogenation is preferably from about 0.01 to about 3 kg per liter of catalyst per hour, more preferably from about 0.05 to about 1 kg per liter of catalyst per hour.

As hydrogenation gases, it is possible to use any gases which comprise hydrogen and do not have any interfering amounts of catalyst poisons such as CO. For example, it is possible to use reformer offgases. Preference is given to using pure hydrogen as hydrogenation gas.

The hydrogenation is generally carried out in the presence of a homogeneous or heterogeneous catalyst which is suitable for hydrogenations. The hydrogenation is preferably carried out in the presence of a heterogeneous catalyst.

Possible homogeneous catalysts are liquid and/or soluble hydrogenation catalysts, for example Wilkinson catalysts, Crabtree catalysts or Lindlar catalysts.

Heterogeneous catalysts used are, for example, noble metals such as platinum, palladium, ruthenium, osmium, iridium and rhodium or other transition metals such as molybdenum, tungsten, chromium, but in particular iron, cobalt and nickel, either individually or in admixture. The catalyst metals can be used directly in the form of the metal or an inorganic metal compound or the catalyst metals are applied to an inert, inorganic support material such as aluminum oxide, $SiO_2$, $TiO_2$ and activated carbon. The hydrogenation can be carried out without solvents or in the presence of a solvent. As solvents, it is possible to use alcohols, such as methanol, ethanol, propanol, isopropanol, isobutanol or t-butanol, or ethers such as diethyl ether, glycol dimethyl ether, dioxane or tetrahydrofuran. However, the end product formed in the reaction can also be used as solvent. Mixtures of the abovementioned solvents are also possible as solvents.

The aromatic compounds mentioned below are preferably used in the process of the invention for hydrogenating aromatic compounds.

Preferred starting materials are:

aromatic amines such as aniline, benzidine, the isomeric toluidines, the isomeric xylidines, the isomeric xylylenediamines, 1- or 2-aminonaphthalene, TDA isomers (2,4-/2,6-/2,3-/3,4-toluenediamine) or MDA isomers (4,4'-methylenedianiline, 2,4'-methylenedianiline, 2,2'-methylenedianiline, polymeric MDA) and also mixtures thereof;

substituted MDA compounds, such as 3,3'-dimethyl-4,4'-diaminodiphenylmethane, 3,3',5,5'-tetramethyl-4,4'-diaminodiphenylmethane and 2,2',3,3'-tetramethyl-4,4'-diaminodiphenylmethane;

aromatic dinitriles, such as the isomeric phthalonitriles;

aromatic hydroxy compounds such as bisphenol A, bisphenol F or substituted bisphenols;

aromatic acid anhydrides, such as phthalic anhydride; or aromatic acids, such as benzoic acid.

Particular preference is given to conveying aromatic amines as starting materials into a hydrogenation. A process for hydrogenating aromatic amines is disclosed, for example, in DE-A1-2132547.

According to the invention, the product of the hydrogenation of the aromatic compound is used as auxiliary liquid. The main product which is preferentially formed under the conditions of the hydrogenation is preferably used as auxiliary liquid.

The method of the invention is, as indicated above, also preferably suitable for conveying carboxylic acids or carboxylic acid derivatives which are used in a process for preparing esters or polyesters, for example by esterification or transesterification.

The present invention accordingly provides a process for preparing esters, wherein a carboxylic acid or a carboxylic acid derivative or a solution of a carboxylic acid or a carboxylic acid derivative is fed to the reactor by means of a displacement pump having physically separate forward-transport valves and a liquid-filled bidirectional flow line between displacement pump and forward-transport valves, where an auxiliary liquid which is the product of the ester preparation or an alcohol used as starting material is present in the bidirectional flow line and the auxiliary liquid has a melting point which is below the melting point of the carboxylic acid or the carboxylic acid derivative or below the saturation temperature of the solution of the carboxylic acid or the carboxylic acid derivative.

To prepare the esters, it is possible, as described, for example, in Ullmann's Encyclopedia of Industrial Chemistry, Polyesters (Electronic Release DOI: 10.1002/14356007.a21_227), to condense the abovementioned carboxylic acids or carboxylic acid derivatives and the abovementioned alcohols in the absence of catalyst or preferably in the presence of esterification catalysts, advantageously in an atmosphere of inert gases, such as nitrogen, carbon monoxide, helium, argon, etc. in the melt at temperatures of from 150 to 250° C., preferably from 180 to 220° C., optionally under reduced pressure to the desired acid number which is advantageously less than 10, preferably less than 2.

To prepare polyester polyols, the organic polycarboxylic acids and/or derivatives and polyhydric alcohols are advantageously used in a molar ratio of 1:1-1.8, preferably 1:1.05-1.2.

As catalysts it is possible to use basic or acidic catalysts, preferably acidic catalysts such as toluene sulfonic acids, preferably metal-organic compounds, in particular ones based on titanium or tin, e.g. titanium tetrabutoxide or tin(II) octoate.

Preferred carboxylic acids are:

aromatic carboxylic acids, such as benzoic acid, in particular aromatic dicarboxylic acids, such as phthalic acid, isophthalic acid, terephthalic acid or the isomeric naphthalenedicarboxylic acids; or aliphatic carboxylic acids, in particular aliphatic dicarboxylic acids, such as adipic acid, succinic acid, glutaric acid, suberic acid, azelaic acid, sebacic acid, decanedicarboxylic acid, maleic acid or fumaric acid.

The carboxylic acids can be used either individually or in admixture with one another. In this embodiment, the corresponding carboxylic acid derivatives of carboxylic acids, for example the corresponding carboxylic anhydrides or esters thereof, for example the $C_1$-$C_4$ esters of the abovementioned carboxylic acids, can also be used as starting materials. Preference is given to using the corresponding carboxylic anhydrides of the abovementioned carboxylic acids, in particular phthalic anhydride, maleic anhydride or succinic anhydride.

According to the invention, the product of the ester preparation or an alcohol which is used as starting material in the preparation of the ester is used as auxiliary liquid.

The method of the invention is particularly suitable for conveying compounds which have a high melting point or are present in the form of concentrated solutions and have a high saturation temperature. Such substances can, owing to the high melting point or their high saturation temperature, form deposits at insufficiently heated places in the pump. However, heating of pumps is technically complicated since, firstly, not all conventional materials used for the construction of pumps are heat resistant, in particular diaphragms and seals. The production of high-temperature pumps is thus comparatively expensive and they still give a poorer performance compared to conventional pumps which can be operated at ambient temperature.

The method of the invention enables high-melting compounds or highly concentrated solutions to be conveyed by means of conventional pumps, with the tendency for deposits to be formed in the region of the pump system being reduced. This makes a long period of operation between maintenance operations possible. Furthermore, the wear of the pumps is reduced, so that their life is increased.

A further advantage is that the reaction mixture is not contaminated by substances extraneous to the reaction which would otherwise have to be separated off from the desired product in complicated steps.

The invention is illustrated by the following examples.

EXAMPLES

Example 1

Hydrogenation of Toluenediamine to Cycloaliphatic Diamines

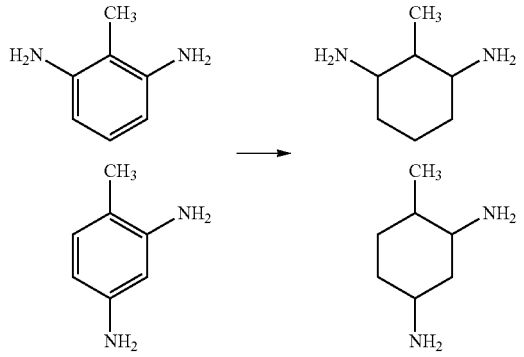

| Starting material (liquid to be pumped) | Melting point ° C. | Reaction product "auxiliary liquid" | Melting point ° C. |
|---|---|---|---|
| 2,4-Toluenediamine (TDA) | 97 | 2,4-Diamino-1-methylcyclohexane | <0 |
| 2,6-Toluenediamine (TDA) | 104 | 2,6-Diamino-1-methylcyclohexane | <0 |

Example 2

Hydrogenation of Optionally Substituted MDA to Cycloaliphatic Amines

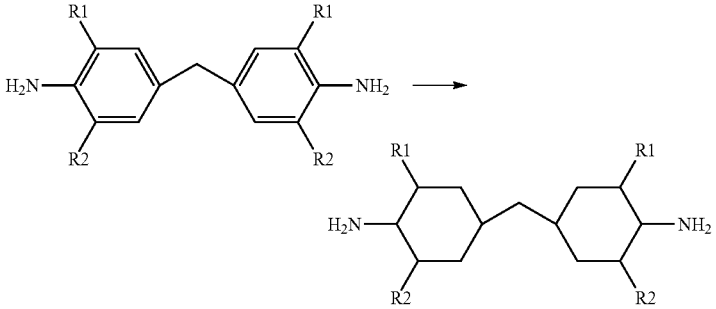

| R1 | R2 | Starting material (liquid to be pumped) | Melting point ° C. | Reaction product "auxiliary liquid" | Melting point ° C. |
|---|---|---|---|---|---|
| H | H | 4,4'-Methylenedianiline (MDA) | 89 | 4,4'-Diaminodicyclohexylmethane (PACM50) | 45 |
| | | | | 4,4'-Diaminodicyclohexylmethane (PACM20) | 15 |
| $CH_3$ | H | 3,3'-Dimethyl-4,4'-diaminodiphenylmethane | 159 | 3,3'-Dimethyl-4,4'-diaminodicyclohexylmethane | <0 |
| $CH_3$ | $CH_3$ | 3,3',5,5'-Tetramethyl-4,4'-diaminodiphenylmethane | 121 | 3,3',5,5'-Tetramethyl-4,4'-diaminodicyclohexylmethane | <0 |

Example 3

Hydrogenation of Aromatic Dinitriles to Cycloaliphatic Diamines

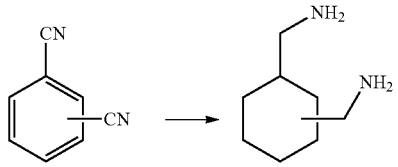

| Starting material (liquid to be pumped) | Melting point ° C. | Reaction product "auxiliary liquid" | Melting point ° C. |
|---|---|---|---|
| m-Phthalonitrile | 163 | 1,3-bis(aminomethyl)cyclohexane | <0 |
| o-Phthalonitrile | 140 | 1,2-bis(aminomethyl)cyclohexane | <0 |
| p-Phthalonitrile | 224 | 1,4-bis(aminomethyl)cyclohexane | <0 |

Example 4

Hydrogenation of Optionally Substituted Bisphenols to Cycloaliphatic Diols

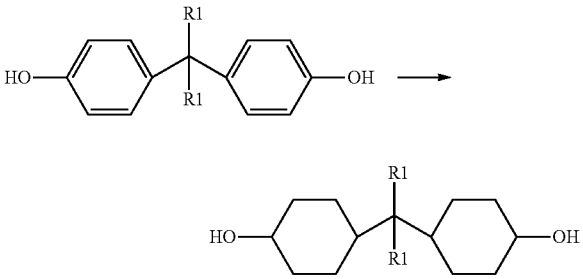

| R1 | Starting material (liquid to be pumped) | Melting point ° C. | Reaction product "auxiliary liquid" | Melting point ° C. |
|---|---|---|---|---|
| $CH_3$ | Bisphenol A | 158 | 2,2-bis(4-hydroxycyclohexyl)propane | <50 |
| H | Bisphenyl F | 162 | Bis(4-hydroxycyclohexyl)methane | <50 |

Example 5

Hydrogenation of Acid Anhydrides and Aromatic Acids to the Corresponding Cycloaliphatic Compounds

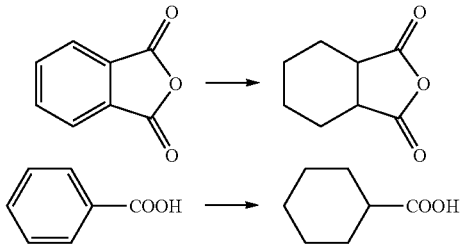

| Starting material (liquid to be pumped) | Melting point ° C. | Reaction product "auxiliary liquid" | Melting point ° C. |
|---|---|---|---|
| Phthalic anhydride | 131 | Cyclohexane-1,2-dicarboxylic anhydride | 32 |
| Benzoic acid | 121 | Cyclohexanecarboxylic acid | 28 |

Example 6

Esterification of Benzoic Acid with Various Alcohols to Form the Corresponding Esters of Benzoic Acid

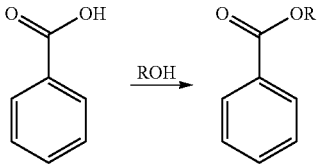

| Starting material (liquid to be pumped) | Melting point ° C. | Reaction product "auxiliary liquid" | Melting point ° C. |
|---|---|---|---|
| Benzoic acid | 121 | Methyl benzoate | −12 |
| | 121 | Ethyl benzoate | −34 |
| | 121 | Butyl benzoate | −20 |

Example 7

Esterification of Dicarboxylic Acids with Various Alcohols to Form the Corresponding Esters of Adipic Acid

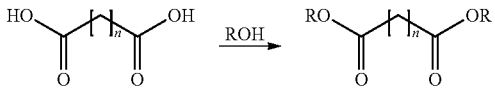

| Starting material (liquid to be pumped) | Melting point ° C. | Reaction product "auxiliary liquid" | Melting point ° C. |
|---|---|---|---|
| Adipic acid (n = 4) | 151 | Dimethyl adipate | 10 |
| | 151 | Diethyl adipate | −20 |
| | 151 | Dibutyl adipate | −25 |
| Glutaric acid (n = 3) | 98 | Dimethyl glutarate | −40 |
| | 98 | Diethyl glutarate | −24 |
| Succinic acid (n = 2) | 184 | Dimethyl succinate | 19 |
| | 184 | Diethyl succinate | −21 |

Example 8

Preparation of Polyesters from Dicarboxylic Acids and Diols

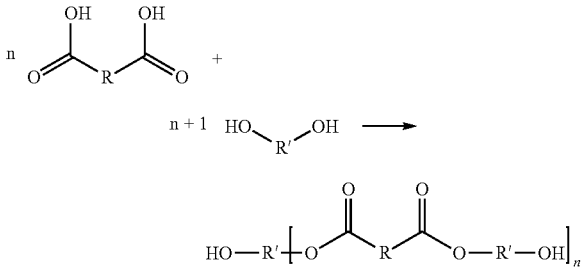

| Starting material* | Melting point ° C. | "Auxiliary liquid" = diol | Melting point ° C. |
|---|---|---|---|
| Adipic acid (n = 4) | 151 | Ethylene glycol | −16 |
| Glutaric acid (n = 3) | 98 | Diethylene glycol | −6 |
| Succinic acid (n = 2) | 184 | 1,4-butanediol | 20 |
| Phthalic anhydride | 131 | 1,3-propanediol | −26 |
| Terephthalic acid | Sublimation at >300° C. | Ethylene glycol | −16 |

*as starting material, it is possible to use, for example, a melt of the starting material, a concentrated solution of the starting material or a suspended finely divided solid of the starting material ("slurry operation") in one of the auxiliary liquids mentioned in the right-hand column or a process solvent.

The invention claimed is:

1. A method of continuously conveying a. liquid which is used as starting material in a chemical reaction by means of a displacement pump having physically separate forward-transport valves and a liquid-filled bidirectional flow line between displacement pump and forward-transport valves, wherein an auxiliary liquid which is a product or a starting material of the chemical reaction and has a melting point which is below the melting point or below the saturation temperature of the liquid to be conveyed is present in the bidirectional flow line, the auxiliary liquid forming a liquid barrier which prevents spreading of the liquid to be conveyed into the bidirectional flow line, and the auxiliary liquid reducing formation of deposits in the pump system.

2. The method according to claim 1, wherein the liquid is an organic compound.

3. The method according to claim 2, wherein the organic compound is an aromatic compound, the chemical reaction is a hydrogenation and the product of the hydrogenation of the aromatic compound is used as auxiliary liquid.

4. The method according to claim 3, wherein the aromatic compound is an aromatic amine.

5. The method according to claim 4, wherein the organic compound is a carboxylic acid or a carboxylic acid derivative, the chemical reaction is a process for preparing esters and the ester formed in the reaction or the alcohol used as starting material is used as auxiliary liquid.

6. The method according to claim 1, wherein the liquid has a melting point or a saturation temperature of from 50 to 300° C.

7. The method according to claim 1, wherein the melting point of the auxiliary liquid is 50° C. or less.

8. The method according to claim 1, wherein the displacement pump is a diaphragm pump.

9. The method according to claim 1, wherein the auxiliary liquid is introduced continuously into the bidirectional flow line.

10. The method according to claim 1, wherein the ratio of the volume flow of auxiliary liquid to the volume flow of the liquid to be conveyed is in the range from 1:10 to 1:100.

11. The method according to claim 1, wherein the auxiliary liquid is introduced using a diaphragm pump.

12. The method according to claim 1, wherein the drives of the pump for conveying the auxiliary liquid and of the displacement pump are mechanically or electronically coupled to one another.

13. A process for hydrogenating aromatic compounds, wherein an aromatic compound or a solution of an aromatic compound is fed to the reactor by means of a displacement pump having physically separate forward-transport valves and a liquid-filled bidirectional flow line between displacement pump and forward-transport valves, where an auxiliary liquid which is the product of the hydrogenation of the aromatic compound is present in the bidirectional flow line and the auxiliary liquid has a melting point which is below the melting point of the aromatic compound or below the saturation temperature of the solution of the aromatic compound, the auxiliary liquid being the hydrogenated aromatic compound, the auxiliary liquid forming a liquid barrier which prevents spreading of the liquid to be conveyed into the bidirectional flow line, and the auxiliary liquid reducing formation of deposits in the pump system.

14. A process for preparing esters, wherein a carboxylic acid or a carboxylic acid derivative or a solution of a carboxylic acid or a carboxylic acid derivative is fed to the reactor by means of a displacement pump having physically separate forward-transport valves and a liquid-filled bidirectional flow line between displacement pump and forward- transport valves, where an auxiliary liquid which is the product of the ester preparation or an alcohol used as starting material is present in the bidirectional flow line and the auxiliary liquid has a melting point which is below the melting point of the carboxylic acid or the carboxylic acid derivative or below the saturation temperature of the solution of the carboxylic acid or the carboxylic acid derivative, the auxiliary liquid forming a liquid barrier which prevents spreading of the liquid to be conveyed into the bidirectional flow line, and the auxiliary liquid reducing formation of deposits in the pump system.

15. The use of a product formed by hydrogenation of an aromatic compound as auxiliary liquid for conveying aromatic compounds by means of a pump system which comprises a displacement pump having physically separate forward-transport valves and a liquid-filled bidirectional flow line between displacement pump and forward-transport valves.

16. The use of an alcohol or a carboxylic ester as auxiliary liquid for conveying a carboxylic acid or carboxylic acid derivative or a solution of a carboxylic acid or a carboxylic acid derivative by means of a pump system which comprises a displacement pump having physically separate forward-transport valves and a liquid-filled bidirectional flow line between displacement pump and forward-transport valves.

* * * * *